US009562365B2

(12) United States Patent
Bucsa

(10) Patent No.: US 9,562,365 B2
(45) Date of Patent: Feb. 7, 2017

(54) DEVICE FOR INSTALLING TILES

(71) Applicant: Doru Bucsa, Oakville (CA)

(72) Inventor: Doru Bucsa, Oakville (CA)

(73) Assignee: Metronic Technologies Corporation, Oakville, ON (CA)

( * ) Notice: Subject to any disclaimer, the term of this patent is extended or adjusted under 35 U.S.C. 154(b) by 0 days.

(21) Appl. No.: 14/703,884

(22) Filed: May 5, 2015

(65) Prior Publication Data

US 2016/0326754 A1 Nov. 10, 2016

(51) Int. Cl.

*E04F 21/00* (2006.01)
*E04F 21/18* (2006.01)
*E04F 21/20* (2006.01)

(52) U.S. Cl.

CPC ..... *E04F 21/1877* (2013.01); *E04F 21/0092* (2013.01); *E04F 21/18* (2013.01); *E04F 21/20* (2013.01)

(58) Field of Classification Search

CPC .... E04F 21/1877; E04F 21/0092; E04F 21/18; E04F 21/20

See application file for complete search history.

(56) References Cited

U.S. PATENT DOCUMENTS 7,257,926 B1 * 8/2007 Kirby ..... E04F 15/02005 33/526
8,181,409 B1 * 5/2012 Jones ..... E04F 21/0092 33/526
8,429,878 B1 * 4/2013 Hoffman ..... E04F 13/0889 52/747.11
8,635,815 B2 * 1/2014 Bordin ..... E04F 21/0092 33/526
9,228,363 B2 * 1/2016 Kufner ..... E04F 21/0092
2002/0121027 A1 * 9/2002 Kruskamp ..... E04F 21/0092 33/526
2006/0185319 A1 * 8/2006 Kufner ..... E04F 13/0892 52/749.11
2007/0214743 A1 * 9/2007 Alvarez ..... E04F 21/0092 52/749.11
2009/0126213 A1 * 5/2009 Tavy ..... E04F 21/0092 33/527
2009/0260317 A1 * 10/2009 Burns ..... E04F 21/0092 52/749.11

(Continued)

FOREIGN PATENT DOCUMENTS

IT EP 2549030 A2 * 1/2013 ..... E04F 21/0092
IT EP 2762658 B1 * 9/2015 ..... E04F 21/0092

*Primary Examiner* — Adriana Figueroa

(57) ABSTRACT

A two part device is used in leveling and spacing tiles. The device includes two parts, a rotatable portion called a knob-cam and a fixed portion called hook-base. The hook-base includes ribs for spacing and separating tiles, and a neck portion extending through a slot opening in the knob-cam. In use, the hook-base portion is set down and tiles are laid down and spaced by the ribs of the base portion. The neck portion extends upwardly above the tiles, and is adapted to be broken away upon application of sufficient upward force or sideways force. The knob-cam includes two diametral opposed frontal action cam surfaces that engage portions of the hook when the knob-cam is rotated. The knob-cam is rotated until the tiles are secured between the knob-cam and the hook-base. This clamps the corners or edges of the tiles, making coplanar upper surfaces.

15 Claims, 8 Drawing Sheets

(56) References Cited

U.S. PATENT DOCUMENTS

| | | | | |
|---|---|---|---|---|
| 2011/0011031 | A1* | 1/2011 | Kufner | E04F 15/02005 52/749.11 |
| 2012/0297714 | A1* | 11/2012 | Tavy | E04F 21/0092 52/309.1 |
| 2013/0055675 | A1* | 3/2013 | Sighinolfi | E04F 21/0092 52/749.11 |
| 2013/0247508 | A1* | 9/2013 | Hoffman | E04F 21/00 52/749.11 |
| 2014/0033641 | A1* | 2/2014 | Trevisi | E04F 21/0092 52/749.1 |
| 2015/0211243 | A1* | 7/2015 | Irvine | E04F 21/0092 52/126.1 |

* cited by examiner

STEP 1 - Knob-Cam inserted through the central slot

STEP 2 - Knob-Cam rotated and locked, consequently clamping tiles

DEVICE FOR INSTALLING TILES

CROSS REFERENCE TO RELATED APPLICATIONS

Not applicable.

STATEMENT REGARDING FEDERALLY SPONSORED RESEARCH OR DEVELOPMENT

Not applicable.

FIELD OF THE INVENTION

The present invention relates to a device for leveling and spacing tiles.

BACKGROUND OF THE INVENTION

It is a problem in the art, when laying tiles on a surface, to equally level the tiles to be coplanar and space the tiles. This is applicable to laying tiles on surfaces in general, including floors, walls, ceilings, and on other surfaces which can support tiles. The term tiles should be understood as including panels, sheets, boards, paving stones, and other materials capable of being laid out in a pattern.

SUMMARY OF THE INVENTION

From the foregoing, it is seen that it is a problem in the art to provide a device meeting the above requirements. According to the present invention, a device is provided which meets the aforementioned requirements and needs in the prior art. Specifically, the device according to the present invention provides a device for leveling and spacing tiles.

The present invention provides a two part device for use in leveling and spacing tiles. The device includes two parts, a rotatable portion and a fixed portion. The rotatable portion referred to hereinafter as a knob-cam includes two helical diametral opposed frontal action cams, a domed knob portion, a central opening, a knurled or ribbed portion and an annular surface portion. The fixed portion referred to hereinafter as a hook-base includes a base with flat surfaces for seating the tiles and ribs for spacing and separating tiles, a neck portion extending through a slot in the knob-cam and double blades which will engage with the double cam. The installation does not require tools.

In use, the base portion is inserted from the side underneath the tiles and spaced by the ribs in between the tiles. After insertion of the base portion will be installed all surrounding tiles, and then the knob-cam will be inserted. The neck portion extends upwardly above the tiles, and is adapted to be broken away after the adhesive sets upon application of sufficient upward force or sideways force. The knob-cam is placed against the tiles such that the neck extends through the key opening. The knob-cam includes two diametral opposed frontal action cam surfaces that engage the blades when the knob-cam is rotated. The knob-cam is rotated until the tiles are temporarily secured between the knob-cam and the base. Adhesive is used to permanently secure the tiles on the surface. The device evenly holds the tiles in correct position during the curing process. When the adhesive is set, the neck and hook portions can be removed by breaking them away from the base portion. Clamping is provided from opposite directions, fastening the tiles in such a way that the upper surface of the tiles will be coplanar, having correct reciprocal positions. Optionally the device may be used in conjunction with regular spacers, wider than the ribs and the device is providing just clamping force.

Other objects and advantages of the present invention will be more readily apparent from the following detailed description when read in conjunction with the accompanying drawings.

DETAILED DESCRIPTION OF THE INVENTION

Figure 1:
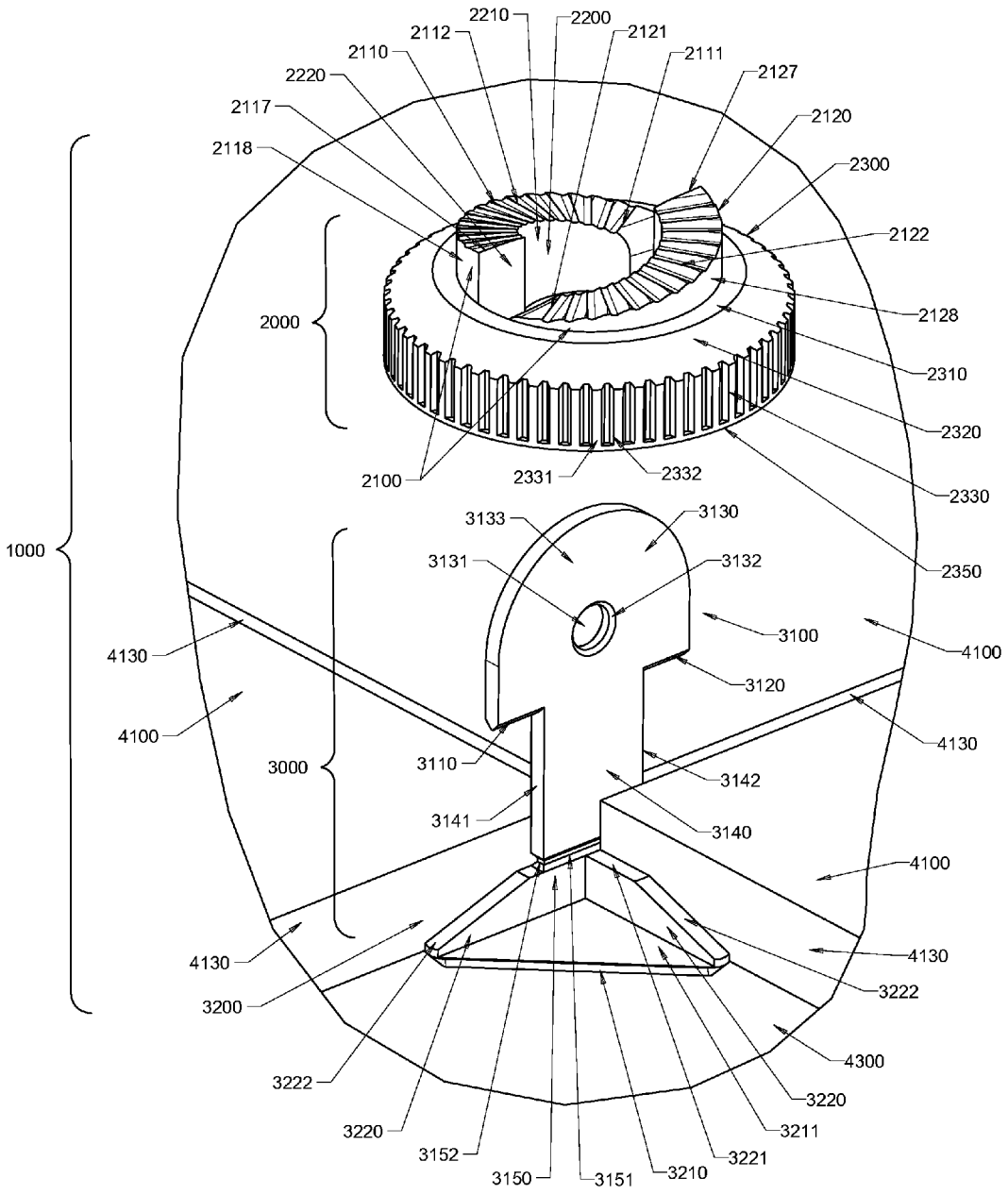
FIG. 1 is a perspective view of a device for use in leveling and spacing tiles, the device having a knob-cam portion and a hook-base portion shown separated prior to assembly, and with some tiles in place with the hook-base portion.

A device 1000 according to the present invention is shown in FIG. 1, depicting a knob-cam portion 2000 and a hook-base portion 3000. The hook-base portion 3000 includes a hook 3100 and a base 3200. Three tiles 4100 are shown mounted against the base 3200 of the base portion 3000, and the tiles 4100 are shown as having side walls 4130. There is room for a fourth tile 4100 against the base portion 3200, which has been omitted for the sake of illustration. The device 1000 is provided for use in leveling and spacing tiles. The knob-cam portion 2000 is shown separated from the hook-base portion 3000, prior to assembly.

As shown in FIG. 1 and in FIGS. 4-6, the knob-cam portion 2000 has a domed knob shape 2300 and includes a pair of frontal cams 2100 (including a left cam 2110 and a right cam 2120, the left cam 2110 having an engaging edge 2111, a helical teethed and stepped cam profile 2112, an uppermost edge 2117, and an outer wall 2118. The right frontal cam 2120 has an engaging edge 2121, a helical teethed and stepped cam profile 2122, an uppermost edge 2127, a central opening 2200, a central key hole 2210, a central key slot 2220, an outer wall 2128, a knurling 2330 formed by alternating raised portions 2331 and recesses 2332, a surface 2310, a surface 2320, and an annular seating bottom surface 2350.

The hook-base portion 3000 is formed by a hook 3100 and a base 3200. The hook 3100 has a rounded key 3130 formed by a tongue 3133 which has a central hole 3131 with a chamfer 3132, a pair of engaging blades 3110 and 3120, and a neck 3140 which has two side surfaces 3141 and 3142. The neck 3140 is connected to the base 3200 by breakable portions 3150, consisting in the edge 3151 and the corners 3152 which are disposed at a bottom region of the neck 3140. The base 3200 has a supporting flat wall 3210, a plurality of ribs 3220, each of the ribs 3220 respectively including a slanted portion 3222 and a top portion 3221, and a plurality of flat portions 3211. The plurality of flat portions 3211 respectively receive bottom corner portions of the tiles 4100 which are to be separated by the ribs 3220. The flat portions 3211 are provided between adjacent ones of the ribs 3220.

Figure 2A:
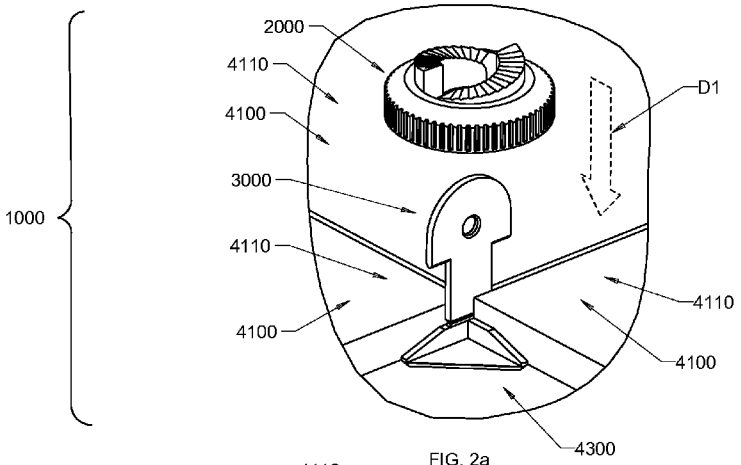
FIG. 2*a* is a perspective view of the device of FIG. 1, showing an assembly step.

FIG. 2*a* is a perspective view of the device of FIG. 1, showing an assembly step in which the knob-cam portion 2000 is brought toward the upper surfaces 4110 of the tiles 4100 in the direction shown by the dashed arrow D1.

Figure 2B:
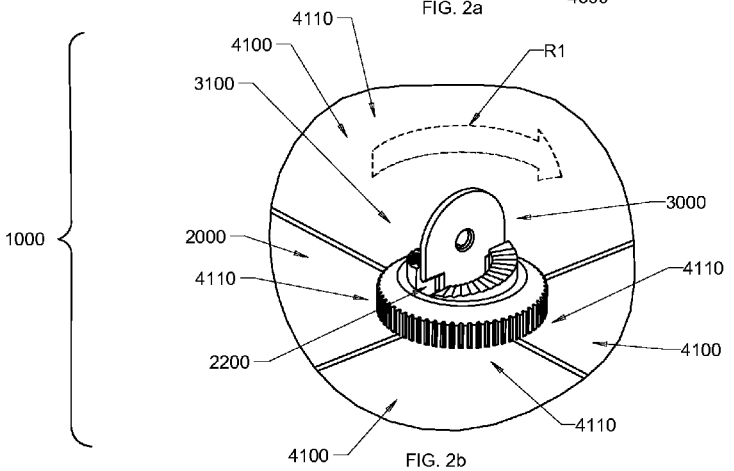
FIG. 2*b* is a perspective view of the device of FIG. 1, showing another assembly step.

FIG. 2*b* is a perspective view of the device of FIG. 1, showing the next assembly step in which the hook 3100 of the hook-base portion 3000 extends through the key opening 2200 of the knob-cam portion 2000 and the blades 3110 and 3120 extend above the cams 2110 and 2120 such that the engaging edges 2111 and 2121 of the cams are below the blades portions 3110 and 3120. The annular surface 2350 is touching the upper portion of tiles 4110. The knob-cam portion 2000 is about to be rotated in the direction shown by the dashed arrow R1, the shown mechanism is unlocked and does not provide residual force.

Figure 2C:
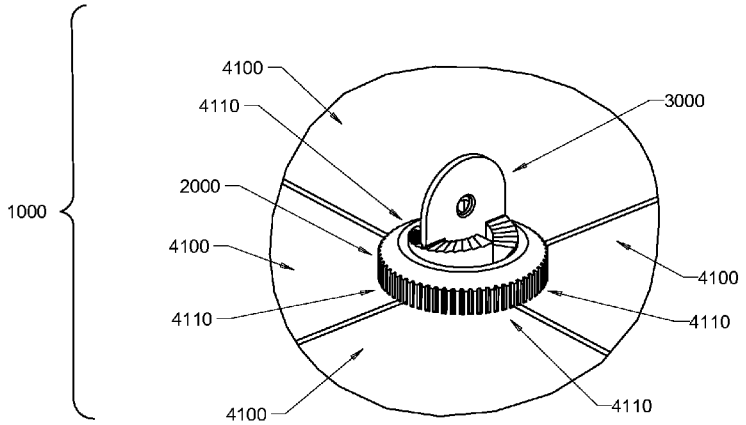
FIG. 2*c* is a perspective view of the device of FIG. 1, showing an assembled configuration.

FIG. 2*c* is a perspective view of the device of FIG. 1, the shown assembly mechanism is locked. By rotating the knob-cam 2000, the frontal cams act as circular wedges and will provide the clamping residual force between the knob-cam 2000 and the tiles 4100. When the knob-cam is rotated beyond the first engaging position, the blades 3110 and 3120 will start climbing on the cams' teethed and stepped profiles 2112 and 2122, generating click sounds which can quantify the residual force necessary for proper clamping. It is important that the rotation is stopped after few clicks, to prevent breakage of the neck 3140 along the breakable portions 3151 and 3152. The clamping effect will self level the upper surfaces of the tiles 4110 until they all touch the annular surface 2350 which creates a datum plane for leveling. The clamping effect is similar to the force provided by the jaws from a vice. The self-leveling effect propagates to all adjacent tiles found under the knob-cam 2000. When the adhesive securing the tiles 4100 has been sufficiently set, the hook 3100 is adapted to be broken by fracture and can be removed, either by further rotation of the knob-cam portion 2000 or by striking of the hook 3100 in a sideways direction. The breaking edges 3152 and 3151 will be below the upper surface of tiles 4110 and will be covered later with grout and hidden. The hook portion 3100 can then be removed and the knob-cam portion 2000 can be reused.

Figure 3A:
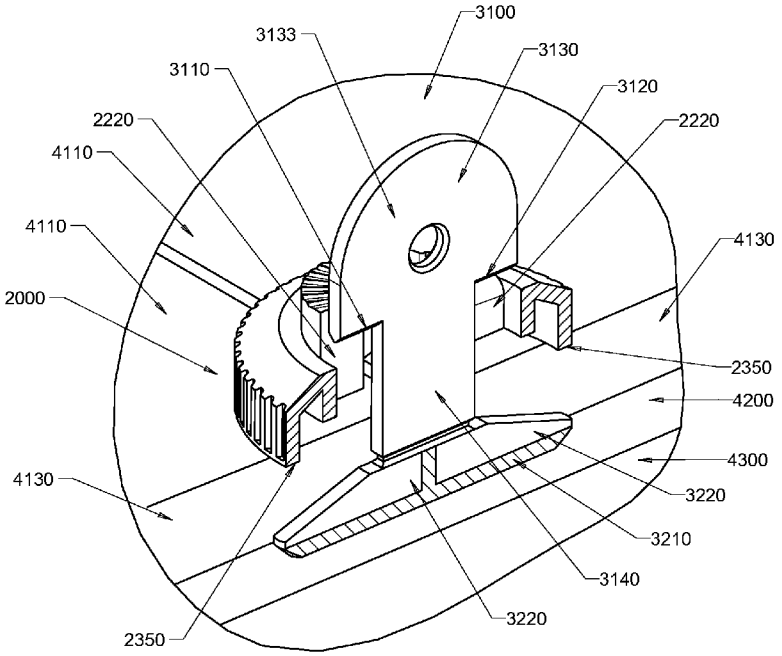
FIG. 3*a* is a perspective section view of the device in the position shown in FIG. 2*b* wherein the hook from the hook-base portion is inserted through a key opening of the knob-cam portion.

FIG. 3*a* is a perspective section view of the device 1000 in the position shown in FIG. 2*b* wherein the hook 3100 of the hook-base portion 3000 is inserted through the key opening 2200 of the knob-cam portion 2000. The mechanism is shown unlocked. Also in this view, the base portion 3200 has a bottom seating wall 3210. The remaining parts are as numbered and described in the foregoing.

Figure 3B:
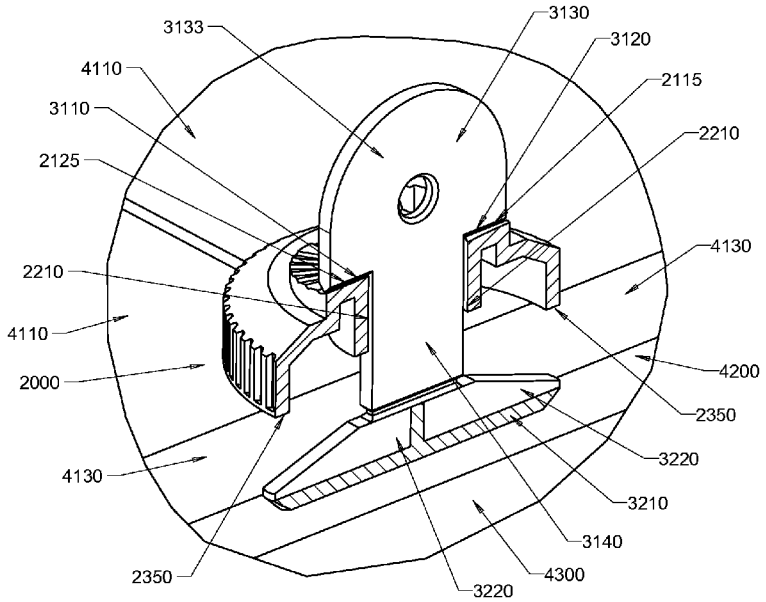
FIG. 3*b* is a view similar to FIG. 3*a*, and wherein the knob-cam portion has been rotated and locked into place with the hook-base portion, consequently clamping tiles.

FIG. 3*b* is a view similar to FIG. 3*a*, and wherein the knob-cam portion 2000 has been rotated and locked into place between the blades portion 3110 and 3120 and radial valleys 2115 and 2125, consequently clamping surrounding tiles 4100 in place. The mechanism is shown locked.

Figure 4A:
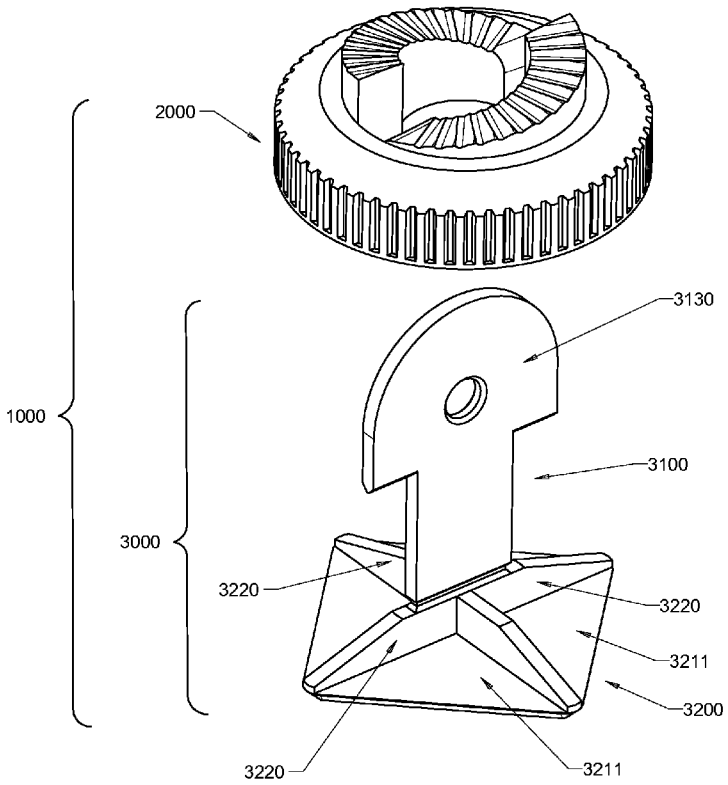
FIG. 4*a* is a perspective view of the knob-cam portion and the hook-base portion of FIG. 1, prior to assembly, and with the tiles omitted for the sake of clarity.

FIG. 4*a* is a perspective view of the device 1000 with the knob-cam portion 2000 and the hook-base portion 3000 of FIG. 1, prior to assembly, and with the tiles 4100 omitted for the sake of clarity. The mechanism is shown unlocked. The remaining parts are as numbered and described in the foregoing.

Figure 4B:
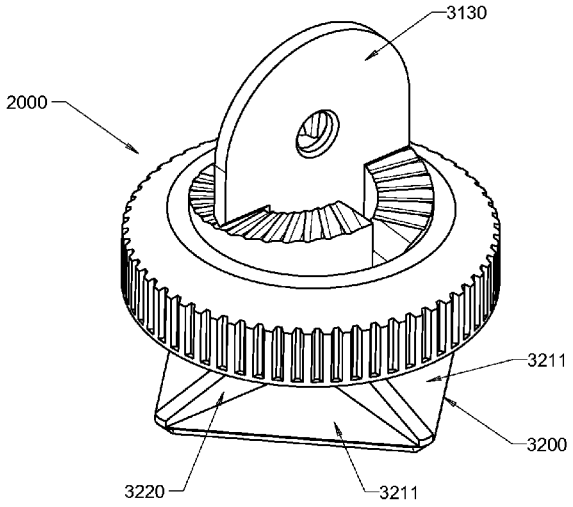
FIG. 4*b* is a perspective view of the device having the knob-cam portion and the hook-base portion of FIG. 4*a*, following assembly and tightening, and with the tiles omitted for the sake of clarity.

FIG. 4*b* is a perspective view of the device 1000 having the knob-cam portion 2000 and the hook-base portion 3000 of FIG. 4*a*, following assembly and tightening. The mechanism is shown locked. Here the tiles 4100 have been omitted for the sake of clarity.

Figure 5B:
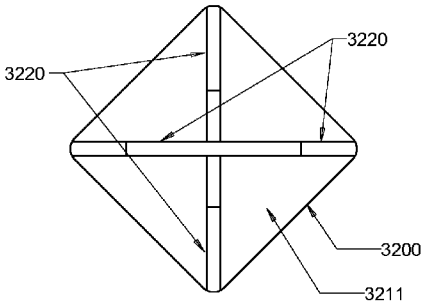
FIG. 5*b* is a top elevational view of the hook-base portion shown in FIG. 5*a*.
Figure 5A:
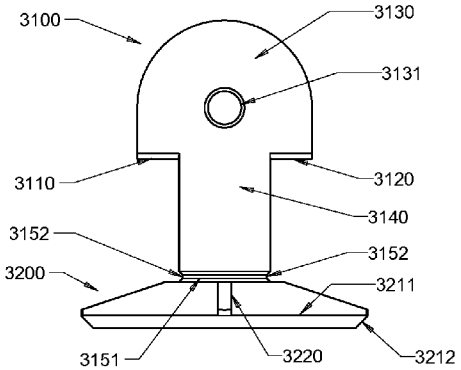
FIG. 5*a* is a front elevational view of the hook-base portion.

FIG. 5*a* is a front elevational view of the hook-base portion 3000, showing the hook 3100, the neck 3140, and the base 3200. Here, the base 3200 is shown having a chamfer 3212 and a seating surface 3211. The central neck 3140 is perpendicular to the base's flat seating surfaces 3211. The tongue portion 3130 from the key 3100 is suitable for gripping by the user during the rotation of knob-cam 2000. The ribs 3220 from the base 3200 have continuous material with no gaps in between. The ribs 3220 provide equidistant spacing between adjacent tiles and can be made in a plurality of colors, each color representing a different spacing distance between tiles. The remaining parts are as numbered and described in the foregoing.

Figure 5C:
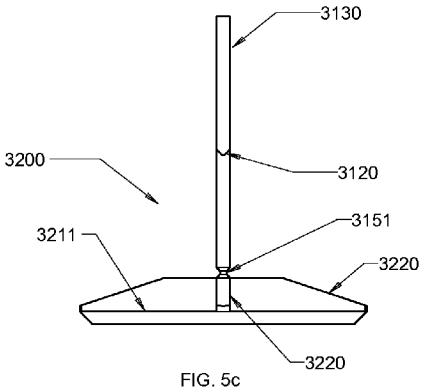
FIG. 5*c* is a right side elevational view of the hook-base portion of FIG. 5*a*.

FIG. 5*b* is a top elevational view of the hook-base portion 3000 having the seatings surfaces 3211 of the base 3200 as shown in FIG. 5*a*. The remaining parts are as numbered and described in the foregoing. FIG. 5*c* is a right side elevational view of the hook-base portion 3000 having the base 3200 shown in FIG. 5*a*. The remaining parts are as numbered and described in the foregoing.

Figure 6A:
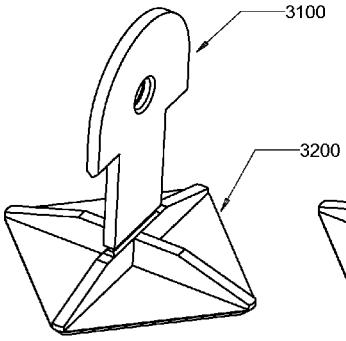
FIG. 6*a* is a perspective view of the hook-base portion of FIG. 5*a*, for use with four tiles.

FIG. 6*a* is a perspective view of the hook-base portion 3000 having the base 3200 shown in FIG. 5*a*, for use with four tiles.

Figure 6B:
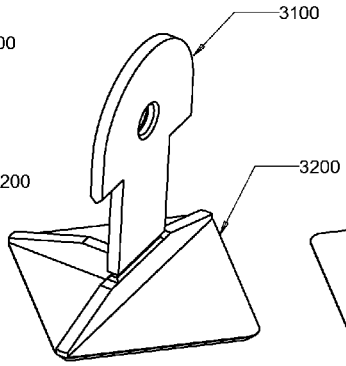
FIG. 6*b* is a perspective view of a second embodiment of the hook-base portion, for use with three tiles.

FIG. 6*b* is a perspective view of a second embodiment of the hook-base portion 3000 having the base 3200, for use with three tiles.

Figure 6C:
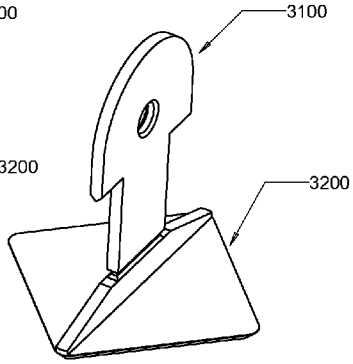
FIG. 6*c* is a perspective view of a third embodiment of the hook-base portion, for use with two tiles.

FIG. 6*c* is a perspective view of a third embodiment of the hook-base portion 3000 having the base 3200, for use with two tiles.

Figure 7B:
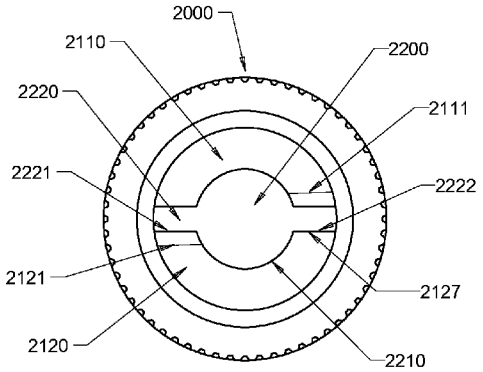
FIG. 7*b* is a top elevational view of the knob-cam portion of FIG. 7*a*. The radial valleys have been omitted for the sake of clarity
Figure 7A:
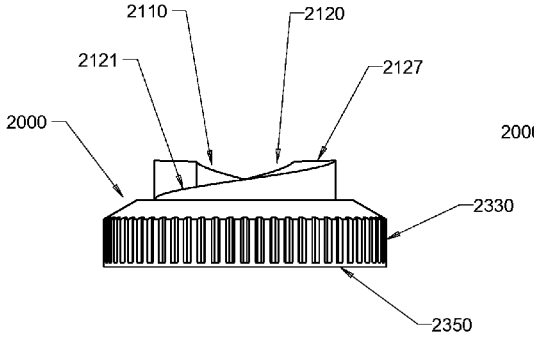
FIG. 7*a* is a front elevational view of the knob-cam portion of FIG. 1. The radial valleys have been omitted for the sake of clarity

FIG. 7*a* is a front elevational view of the knob-cam portion 2000 of FIG. 1, having an annular bottom surface 2350. Here, the cam 2120 is shown having respective engaging edge 2121 and uppermost edge 2127. In this view, the cams are shown with smooth surfaces, for the sake of clarity. By providing clamping force, the tiles will self level guided by the datum plane created by the bottom annular portion 2350 of the knob-cam. The knob-cam 2000 can be reused. The remaining parts are as numbered and described in the foregoing.

FIG. 7*b* is a top elevational view of the knob-cam portion 2000 of FIG. 7*a*. In this view, the cams are shown with smooth surfaces, for the sake of clarity. Here, the central key opening 2200 is shown having a central key hole 2210, a central key slot 2220 and two wing-shaped key slot ends 2221 and 2222. The central key hole 2210 has a diameter sufficient to accommodate and guide during rotation the neck portions 3141 and 3142 of hook-base 3000. The two wing-shaped slot ends 2221 and 2222 are sufficiently wide to accommodate passage of the entire width of the hook 3100 of the hook-base portion 3000.

Figure 7C:
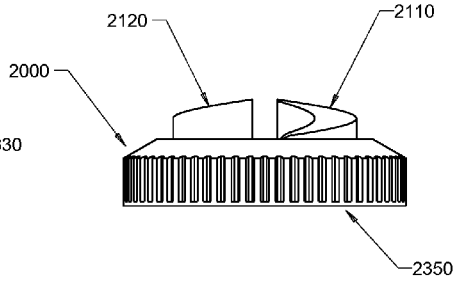
FIG. 7*c* is a side elevational view of the knob-cam portion of FIG. 7*a* as viewed from the right of FIG. 7*a*. The radial valleys have been omitted for the sake of clarity

FIG. 7*c* is a side elevational view of the knob-cam portion of FIG. 7*a* as viewed from the right of FIG. 7*a*. In this view, the cams are shown with smooth surfaces, for the sake of clarity.

Figure 8A:
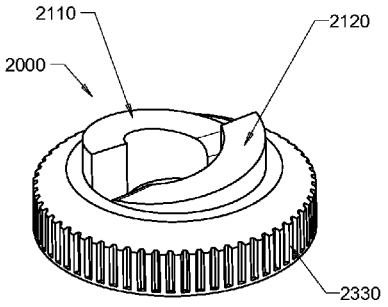
FIG. 8*a* is a perspective view of the knob-cam portion of FIG. 1 showing a knurled portion. The radial valleys have been omitted for the sake of clarity

FIG. 8*a* is a perspective view of the knob-cam portion 2000 of FIG. 1 showing a knurled portion 2330. The remaining parts are as described in the foregoing.

Figure 8B:
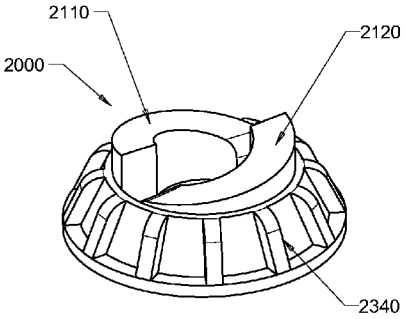
FIG. 8*b* is a perspective view of another embodiment of the knob-cam portion, having a plurality of separated rib portions for manual gripping and turning. The radial valleys have been omitted for the sake of clarity

FIG. 8*b* is a perspective view of another embodiment of the knob-cam portion 2000, having a plurality of separated rib portions 2340 for ease of gripping and rotating. The remaining parts are as described in the foregoing.

Figure 9B:
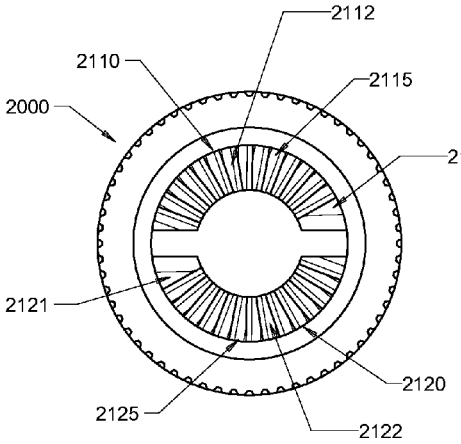
FIG. 9*b* is a top elevational view of the knob-cam portion of FIG. 9A, showing the pair of cams, together with the pairs of radial valleys.
Figure 9C:
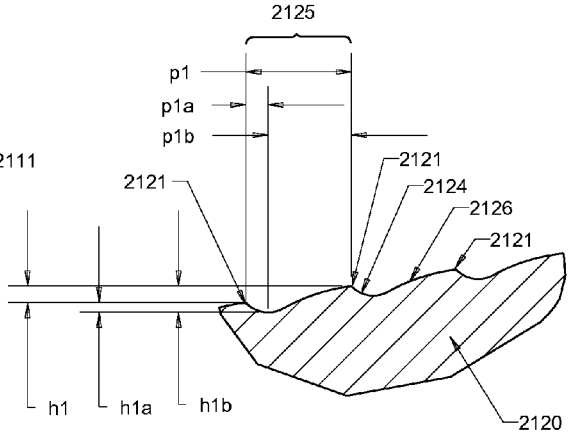
FIG. 9*c* is an enlarged section of a portion of one of the cams, showing a close-up view of the radial valleys and teethed stepped profile.
Figure 9A:
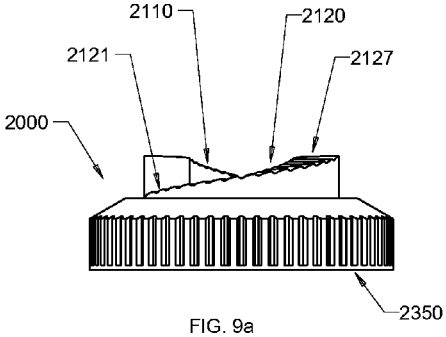
FIG. 9*a* is a side elevational view of a further embodiment of a knob-cam portion, having a pair of cams, and pairs of radial valleys.

FIG. 9*a* is a side elevational view of a further embodiment of a knob-cam portion 2000 of FIG. 1, having an annular bottom surface 2350. Here, the cam 2120 is shown having respective engaging edge 2121 and uppermost edge 2127. By providing clamping force, the tiles will self level guided by the datum plane created by the bottom annular portion 2350 of the knob-cam. The knob-cam 2000 can be reused. The remaining parts are as numbered and described in the foregoing.

FIG. 9*b* is a top elevational view of the knob-cam portion 2000 of FIG. 9A, showing the cam 2110 and the cam 2120, together with the pairs of radial valleys 2115 and 2125. The pairs of radial valleys facilitate seating and locking of the blade portions 3110 and 3120 during operation.

FIG. 9*c* is an enlarged frontal section of a portion of the cam 2120, showing a close-up view of the teethed stepped radial valleys 2125. Each of the radial valleys 2125 has a generally scalloped shape, and includes the edges 2121 which prevents the blade portion 3110 and blade portion 3120 from unlocking itself; a valley portion 2124 which cooperates with the edge 2121 to prevent the blade portion 3110 and blade portion 3120 from unlocking itself; and a hill portion 2126 which allows a smooth transition to the next edge 2121 and provide residual force. Each of the radial valleys 2125 has an axial pitch h1, measured vertically between two consecutive edges 2121, and a depth h1*a* of the valley (which determines the key's sound pitch intensity during turning). Each of the radial valleys 2125 also has a total blade travel h1*b* from the bottom of a valley to the next edge 2121. Each of the radial valleys 2125 has a perimeter pitch p1 (e.g., a length p1), a distance p1*a* between and edge 2121 and the bottom of a valley, and a hill p1*b* which is a distance between the bottom of the valley to the next edge 2121, measured transversely. As seen in FIG. 9*c*, the radial valley 2125 has a concave portion 2124 where the locking ramp of the valley is located and a convex portion 2126 which leads smoothly to the next edge 2121. The cams have axial and frontal action, and the orientation of the edges 2121 from the teethed and stepped profile is in opposite direction from the tiles.

Figure 9D:
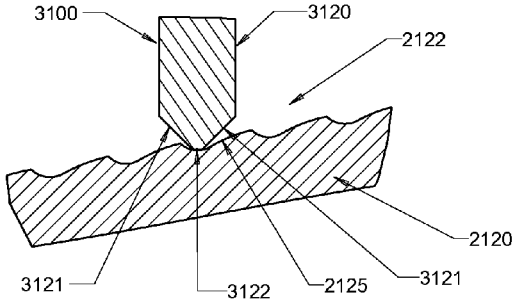
FIG. 9*d* is an enlarged section view of an assembly formed by a blade and a cam, showing a close-up view of a blade engaging with one of the radial valleys.

FIG. 9*d* is an enlarged section view of an assembly formed by a blade 3120 which looks like a V-Notch and the cam teethed and stepped profile 2122. The tip edge 3122 and two adjacent sidewalls 3121 seats and engages with the locking valley portions 2124 wherein the edge 2121 and the locking ramp 2124 prevent the tip blades 3122 from unlocking themselves. Upon further urging of the blade portion 3110 during rotation of the knob-cam portion 2000, the tip 3122 slides upwardly along the hill portion 2126 which forms a smooth transition to the next edge 2121 whereupon the tip 3122 can slide into the next radial valley portion 2125. In this preferred embodiment, this sharp and central V shape is very effective in engaging with the teethed stepped profile on cams. Because the teeth have a radial pattern, i.e. are radially disposed, the blades 3110, 3120 have to engage in a substantially exactly radial manner, and this determines that the sharp blades tips 3122 will be substantially exactly in the middle of the radial valleys 2125 and 2115.

Figure 10:
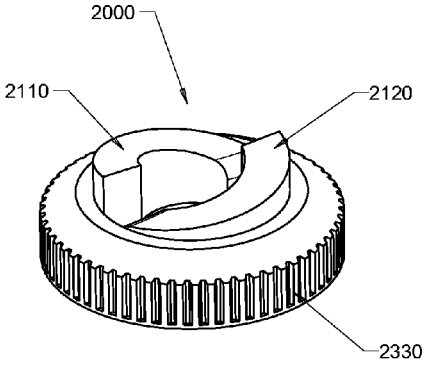
FIG. 10 is a perspective view of a further embodiment of a knob-cam portion which can be used in the device of FIG. 1, wherein the cams have textured or smooth surfaces instead of teethed stepped surfaces.

FIG. 10 is a perspective view of a further embodiment of a knob-cam portion 2000 which can be used in the device of FIG. 1, wherein the cams 2110 and 2120 have smooth or textured surfaces instead of teethed and stepped surfaces.

Figure 11:
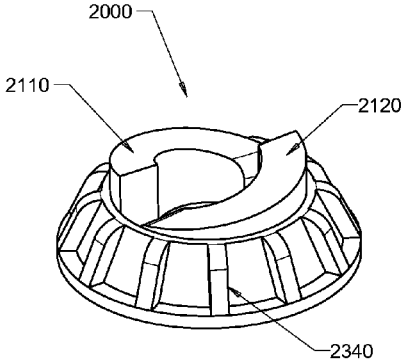
FIG. 11 is a perspective view of a further embodiment of a knob-cam portion which can be used in the device of FIG. 1, wherein the cams are shown, as well as a plurality of spaced ribs for facilitating manual gripping and turning.

FIG. 11 is a perspective view of a further embodiment of a knob-cam portion 2000 which can be used in the device of FIG. 1, wherein the cams 2110 and 2120 have smooth or textured surfaces instead of teethed and stepped surfaces as well as a plurality of ribs 2340 for facilitating manual gripping and turning.

In the foregoing description, the frontal cams have specified surfaces. It is contemplated as being within the scope of the present invention that the frontal surfaces of helical cams can have any of: teethed and stepped surfaces; textured surfaces; or smooth surfaces. This includes teethed stepped surfaces as described above.

Figure 12B:
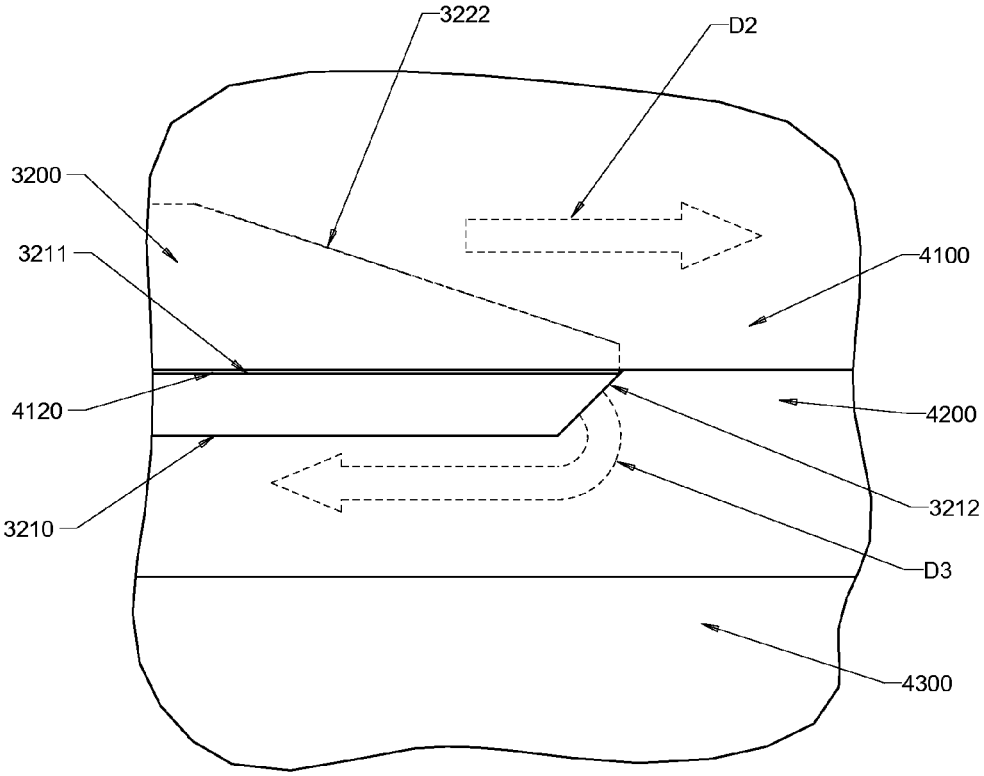
FIG. 12*b* is an enlarged sectional view of the downward oriented chamfer of the hook-base, wherein for the sake of clarity the hatching has been removed.
Figure 12A:
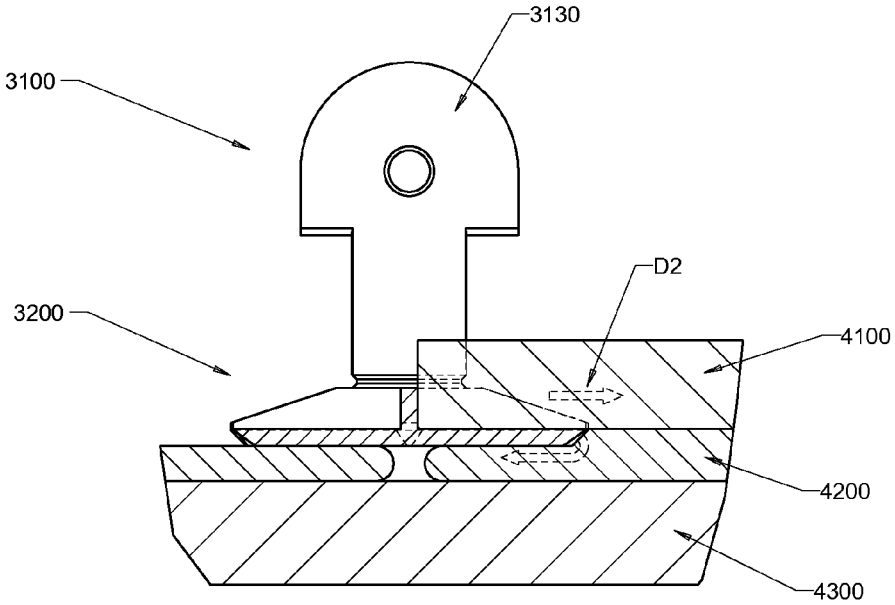
FIG. 12*a* is a side sectional view showing a hook-base portion shown sliding under the tile which is previously disposed on adhesive, and a floor which is covered by the adhesive.

FIG. 12*a* is a frontal sectional view showing a base portion 3200, shown sliding into engagement from the side under the tile 4100 in the direction indicated by an arrow D2. The tile 4100 is disposed on the adhesive 4200 which is covering the floor 4300.

FIG. 12*b* is an enlarged view of the chamfer 3212 portion. In this view the seating wall 3210 through the seating surface 3211 of the base 3200 is supporting a tile 4100. The leading edge of the wall 3100 has the downward oriented chamfer 3212, wherein the chamfer 3212 assists in penetrating the adhesive A along with an arrow labeled D2 showing a direction of insertion or movement. That is, the chamfer 3212 in this process will push down the adhesive 4200 so as to help rub and clean the lower seating surface 4120 of tile 4100 from the adhesive 4200 in the location adjacent to the base 3200. In this view, an arrow labeled D3 shows a direction in which the adhesive A is pushed down by the chamfer 3212, such that adhesive is cleaned from underneath the tile 4100, providing a clean supporting surface.

The invention being thus described, it will be evident that the same may be varied in many ways by a routineer in the applicable arts. Such variations are not to be regarded as a departure from the spirit and scope of the invention and all such modifications are intended to be included within the scope of the claims.

The invention has several preferred embodiments but they are not exclusive. The invention is susceptible of many embodiments, all of which are within the scope of the appended claims. All the details may be substituted by other equivalent elements.

The invention claimed is:

1. A device used for installing tiles, comprising:

a knob-cam which is a rotatable top portion, said knob-cam being adapted for leveling tile surfaces: said knob-cam having a body which has a central opening therethrough, said central opening being in a key shape formed by a central circular portion with a first slot and a second slot, wherein said first slot and said second slot extend in opposite directions from said central circular portion, and said knob-cam having a first cam helically ascending about said central circular portion, said first cam having an upper surface radially extending from said central circular portion, said first cam having a lowermost edge adjacent said first slot: said knob-cam having a second cam helically ascending about said central circular portion, said second cam having an upper surface radially extending from said central circular portion, said second cam having a lowermost edge adjacent said second slot; said knob-cam including a portion adapted for manual gripping, and said knob-cam having a bottom seating guiding surface;

said upper surface of said first cam having a succession of radially extending ascending portions which are scallop shaped, each of said ascending portions of said upper surface of said first cam having a leading edge, a valley portion, and a hill portion;

said upper surface of said second cam having a succession of radially extending ascending portions which are scallop shaped, each of said ascending portions of said upper surface of said second cam having a leading edge, a valley portion, and a hill portion;

a hook-base having a base and a hook, said hook having a tongue portion and a neck connecting said tongue portion to said base; said tongue portion having two engaging blades extending in opposite directions from said neck; said two engaging blades being adapted to engage each of said first and second cams said hook being adapted to pass through said opening in said knob-cam, said hook-base being adapted to space tiles;

wherein said scallop shaped ascending portions of said upper surface of said first cam and said upper surface of said second cam are adapted to seat at a lowermost edge of said two engaging blades in said valley portions;

whereby when said hook is inserted through said central opening, rotation of said knob-cam causes engagement of said first and second cams with said blades of said hook-base, to provide a clamping force between said knob-cam and said hook-base such that adjacent tiles disposed between said knob-cam and said hook-base are urged to be level and spaced.

2. The device of claim 1, wherein said knob-cam has a dome shape with said central opening and is adapted for rotation to clamp from one side and level tiles.

3. The device of claim 1, wherein said first cam and said second cam each have a relatively high ascending angle and wherein said scallop shaped ascending portions on the upper surfaces of each of said first and second cams are pluralities of radial toothed stepped valleys which facilitate seating and locking of said blades providing incremental clamping force increase.

4. The device of claim 3, wherein rotation of said knob-cam relative to said hook-base causes clicking sounds when said engaging blades engage said cams, and said clicking sounds serve as an indication of residual clamping force increase, and wherein each consecutive clicking sounds represents an increment of clamping force increase.

5. The device of claim 1, wherein for each of said ascending portions, said hill portion allows a smooth transition to a valley edge of a following one of said valley portions.

6. The device of claim 1, wherein each said first and second cams has a relatively medium ascending angle and the upper surfaces are textured, which facilitate seating and locking of said blades by friction providing continuous clamping force increase.

7. The device of claim 1, wherein said bottom portion is adapted for supporting and clamping tiles from an opposite side of the tiles from said knob-cam, and is adapted to space the tiles.

8. The device of claim 1, wherein a top portion of said hook-base has a key for easy gripping while said knob-cam is rotated, and said key is adapted to pass through said opening in said knob-cam.

9. The device of claim 1, wherein said hook of said hook-base has a substantially T-shaped body and said blades are disposed on an underside of respective arms of said T-shaped body.

10. The device of claim 1, wherein each of said pair of blades has an engaging profile which narrows to a tipped edge which can engage and lock in a corresponding radial valleys in said cams.

11. The device of claim 1, wherein said neck has a breakable portion which in use is disposed adjacent to said base and wherein rotating said knob-cam occurs in three main steps: (a) initially a bottom surface of said knob-cam approaches an upper surface of said tiles to be clamped, without providing clamping force; (b) once touching the tiles, rotation of said knob-cam starts providing clamping force as said hooks engage with said radially disposed valleys to cause clicking sounds; and (c) after curing of adhesive securing the tiles, upon further rotation of said knob-cam, said neck portion of said key breaks, whereby said hook having said neck and tongue portion can be removed.

12. The device of claim 1, wherein said hook-base has a square shape and its bottom surrounding corners of said hook-base are chamfered downwards, and are adapted to facilitate insertion underneath tiles, and which overlies an adhesive on a surface, providing a relatively clean seating surface between said base and a seating surface of said tiles.

13. The device of claim 1, wherein said bottom portion has material in different colors, each color representing a different rib spacing thickness.

14. The device of claim 1, wherein said hook-base has upstanding rib spacers which have a continuous material diagonally across said hook-base, with no gaps.

15. The device of claim 1, wherein said hook-base can accommodate a specific number of said tiles, said number of tiles being selected from among four, three and two.

* * * * *